United States Patent [19]

Fukuda et al.

[11] Patent Number: 4,757,781

[45] Date of Patent: Jul. 19, 1988

[54] APPARATUS OF HOT DIP PLATING ON ONE SIDE OF STRIP

[75] Inventors: Shuzo Fukuda; Yutaka Ohkubo; Tomihiro Hara, all of Yokohama, Japan

[73] Assignee: Nippon Kokan Kabushiki Kaisha, Tokyo, Japan

[21] Appl. No.: 1,627

[22] Filed: Jan. 8, 1987

Related U.S. Application Data

[63] Continuation of Ser. No. 275,953, Jun. 22, 1981, abandoned.

[30] Foreign Application Priority Data

Jun. 26, 1980 [JP] Japan ..... 55-87174
Dec. 27, 1980 [JP] Japan ..... 55-185453
May 15, 1981 [JP] Japan ..... 56-72929

[51] Int. Cl.[4] ..... B05C 5/02; B05C 3/132; B05C 3/18

[52] U.S. Cl. ..... 118/410; 118/419; 118/429; 427/434.3

[58] Field of Search ..... 118/410, 315, 411, 419, 118/429; 427/434.3, 300, 433

[56] References Cited

U.S. PATENT DOCUMENTS 4,254,158 3/1981 Fukuzuka et al. ..... 427/434.3
4,296,145 10/1981 Higuchi et al. ..... 427/433 X
4,317,845 3/1982 Karasawa et al. ..... 427/433 X
4,323,604 4/1982 Fukuda et al. ..... 427/433

FOREIGN PATENT DOCUMENTS 55-006442 1/1980 Japan ..... 427/434.3
2051879 1/1981 United Kingdom ..... 427/434.3

*Primary Examiner*—John P. McIntosh
*Attorney, Agent, or Firm*—Moonray Kojima

[57] ABSTRACT

An apparatus for hot dip plating on one side of a metal strip, comprising a plurality of nozzles disposed at an oblique angle to the direction of travel of the strip and having outlets which are tilted toward the edges of the strip, whereby splashing of the plating material is avoided, and occurence of plating material on the non-plated side of the strip is also avoided, and the plating is regular and without irregularity of plating or areas lacking plating material.

4 Claims, 11 Drawing Sheets

APPARATUS OF HOT DIP PLATING ON ONE SIDE OF STRIP

This is a continuation of application Ser. No. 275,953 filed June 22, 1981, now abondoned.

BACKGROUND OF THE INVENTION

This invention relates to an apparatus for continuously hot dip plating one side of a metal strip.

There is a demand for steel sheets which are zinc plated on only one side (so-called one side plated steel sheet), and many processes have been proposed for their manufacture. In this case, careful attention should be paid to insure that molten plating material does not contact the upper non-plating surface of the strip which should not be plated. Otherwise, the resulting strips would not be desired products, or would reduce their saleability.

One of the proposed processes is to upheave or swell the surface of the molten plating material by means of a pump, to contact a horizontally disposed surface of a travelling strip, facing the molten plating material. Such a method is described in Japanese Laid Open Patent Specification No. 53-75,124 (laid open to public inspection in 1978), in which zinc is fed from a pump and spouted from a nozzle installed within a zinc bath, and the zinc surface is upheaved to contact the lower surface of the travelling strip which is horizontally held by a plurality of rolls. In this practice, an inert gas is blown by a nozzle which is disposed above the strip, onto the upper surface of the strip in order to prevent the plating material zinc from contacting the upper non-plating surface of the strip. However, this method requires blowing of a large amount of inert gas under high pressure, as a countermeasure to large changes of widths of the strip, its operation is expensive. Also, due to the counterflow of the inert gas, zinc will inevitably be splashed on the upper surface of the strip In view of these deficiencies, the present inventor proposed in Japanese Patent Application No. 67,445/79, a process and an apparatus for uniformly plating molten metal on one side of a steel strip, wherein the strip travels horizontally over a surface of a plating bath while the plating molten metal is jetted onto the lower surface of the strip, facing the bath. The molten metal is jetted from a position adjacent the side edges of the strip, in a plating flow running widthwise of the strip and from a position centrally of the strip, in a plating flow running lengthwise of the strip. However, disadvantageously, in this operation, the nozzles must follow the changes in width of the strip as it moves. Accordingly, it was originally planned to move the center and edge nozzles in response to changes in widths. However, as a practical matter, it was found that such movable portions were complicated mechanically, and difficult to implement operationally, and many other problems were caused.

The present invention aims to overcome the foregoing and other deficiencies of the prior art, and encompasses a novel apparatus which produces uniform plating on one side of a metal strip, without any of the plating material being allowed to contact the non-plating surface of the strip regardless of changes in the width of the moving strip. The invention utilizes appropriately shaped nozzles which are positioned at oblique angles to the moving direction of the strip, and which have nozzle outlets which are suitably tilted toward the edges. The oblique angle and angle of tilt can both be suitably adjusted to prevent plating material from creeping around the edges and contact the non-plating upper surface of the strip, and to prevent the plating material from splashing onto the upper surface and cause spots of such plating material on the upper surface. The shape of the nozzles may be adjusted to enable uniform plating on the lower surface and prevent areas of non-plating or irregular plating to occur.

DETAILED DESCRIPTION OF PREFERRED EMBODIMENTS

Figure 1:
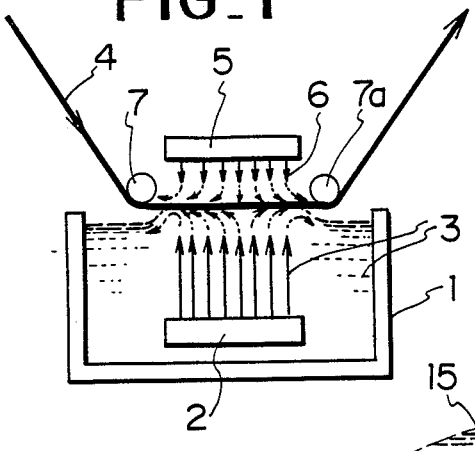
FIG. 1 depicts an outline view showing a conventional one side plating apparatus, using blown inert gas on the upper surface.

Referring to FIG. 1, which depicts a prior art apparatus, plating material, e.g. zinc, fed by a pump (not shown), is spouted from a nozzle 2 installed within the plating bath 1, and the plating material surface is upheaved to contact the lower surface of a moving strip horizontally held and moved by rolls 7, and 7*a*. An inert gas 6 is blown by a nozzle 5 disposed above the other upper surface of strip 4, in order to prevent the plating material from contacting the upper surface. However, since this method requires blowing of a large amount of inert gas under high pressure, as a counter measure against large changes of widths of the moving strip which causes the plating material to be moved to contact the upper surface, its use and operation are expensive. Also, due to the counterflow of inert gas, the plating material will inevitably be splashed on the upper surface of the strip. Thus, this prior art apparatus is deficient and does not provide an acceptable solution.

Figure 2:
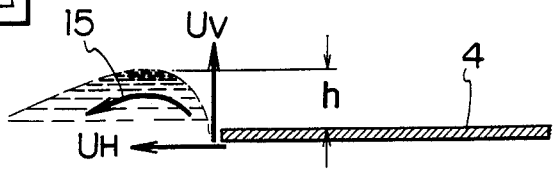
PRIOR ART FIG 2
FIGS. 2 and 3 and 4 depict outline views for explaining the principles of the invention.

The principles of the invention will be explained with reference to FIGS. 2–4. In plating the lower surface, the upper surface may become contaminated in two ways, first, which is called the "invasion phenomenon", wherein the plating material creeps around the edges and goes inward toward the center of the upper surface to produce stripes of plating material thereon; and second, which is called the "splashing phenomenon", wherein drops of plating material splash above the level of the upper surface and then fall down to produce spots of plating material on the upper surface. The present invention aims to overcome each of these phenomena. Also, the plating surface itself may be subjected to certain deficiencies of plating. For example, there may occur at the center areas of the strip spots of areas wherein no plating material is coated. Also, there may occur irregularities of plating depending on the distance from the center line of the strip. The present invention aims to overcome these deficiencies.

INVASION PHENOMENON

Figure 4:
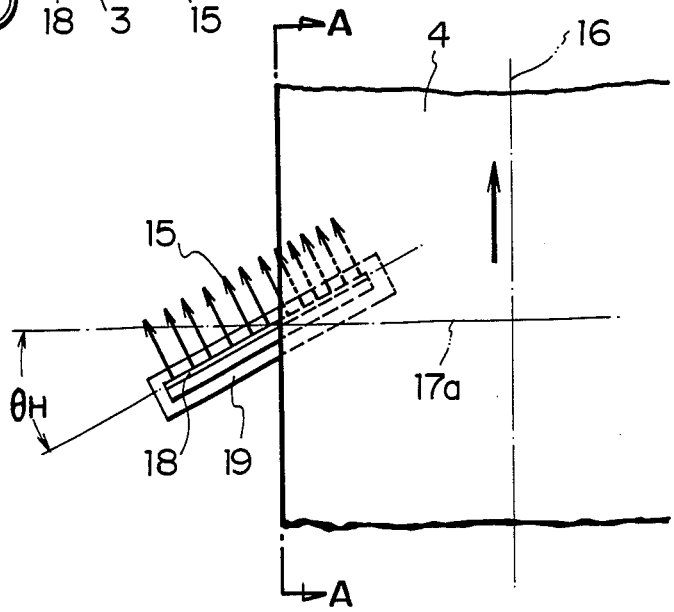

Regarding the unacceptable phenomenon caused by movement of the plating material at the edges of the strip on the upper surface thereof, FIG. 4 shows plating material Zn flowing laterally from the strip edge. Strip 4 is shown running toward the reader with a stream of Zn 15. Arrow $U_H$ in FIG. 2, shows lateral flow velocity at the strip edge. Arrow $U_V$ shows upflow velocity, and h is the height of the upward jetting of the plating material Zn (called upheaving). In the invasion phenomenon, lateral flow velocity of the upheaving is an important factor. If nozzle outlet were outside of the strip 4, Zn would upheave at the height h (see FIG. 2) and if $U_H$ were low, Zn would turn to the non-plating upper surface during the fluttering and meandering of the moving strip 4. The lateral flow velocity $U_H$ at right angle with the moving direction depends upon the line speed (working speed), the shape and amount of meandering of thes strip, and about more than 0.5 m/s is preferable. Namely, it is satisfactory to prepare the nozzle shape for increasing jetting speed and the lateral flow velocity $U_H$ right angled with the moving direction, of the strip.

On the other hand, the occurence of spots of plating metal on the non-plating side due to splashing phenomenon, has close relationship to the upheaving height h in FIG,. 2, and greatly depends upon the upflow velocity $U_V$. As is seen, the lower is the upflow velocity $U_V$, the more preferable it is. This means that the jetting speed is made low, but that would be contrary to the measures to control the invasion phenomenon i.e. flow velocity of less than 0.5 m/s would cause invasion phenomenon occurence).

Figure 3:
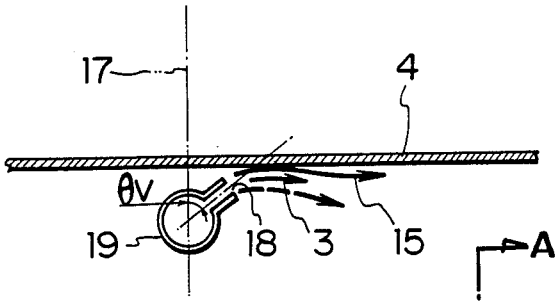

The height h at the high jetting speed may be controlled by tilting the jetting mouth 18 of nozzle header 19, toward the edge of strip 4, as shown in FIG. 3 (this drawing is seen from A—A in FIG. 4). If nozzle header 19 is arranged at an angle which is oblique to the moving direction of the strip 4, it is sufficient to increase the lateral flow velocity $U_H$ right angled with the moving direction, as the first element. In such a manner, the plating material Zn does not enter the non-plating upper surface when the jetting mouth is outside the strip.

The angle ($\theta_V$) of the jetting mouth 18, with respect to the vertical line 17, is preferably within the range of $$30° \leqq \theta_V \leqq 60°$$

Less than 30° causes high upheaving and occurence of the splash phenomenon. More than 60° does not produce appropriate upheaving and the molten plating metal will not contact the lower surface of strip 4. The angle ($\theta_H$) of the nozzle with respect to the base line 17*a* crossing the strip edge in FIG. 4, is preferably within the range of $$20° \leqq \theta_H \leqq 70°$$

More than 20° is at least required for increasing the lateral flow velocity $U_H$ and for controlling invasion phenomenon occurence, even when jetting outlet 18 is outside the strip 4. More than 70° would not bring about such effects. Moreover, more than 70° makes the flowing amount large when plating a variable area of the strip. Also, the nozzle would be long in length, thus making the apparatus uneconomical and non-preferred in view of the occurence of dross.

The invention will be further illustrated immediately below and further hereinafter, with actual examples. The examples and the dimensions and measurements shown are only illustrative and are not to be construed to be limiting in any manner.

EXAMPLE 1

Figure 5:
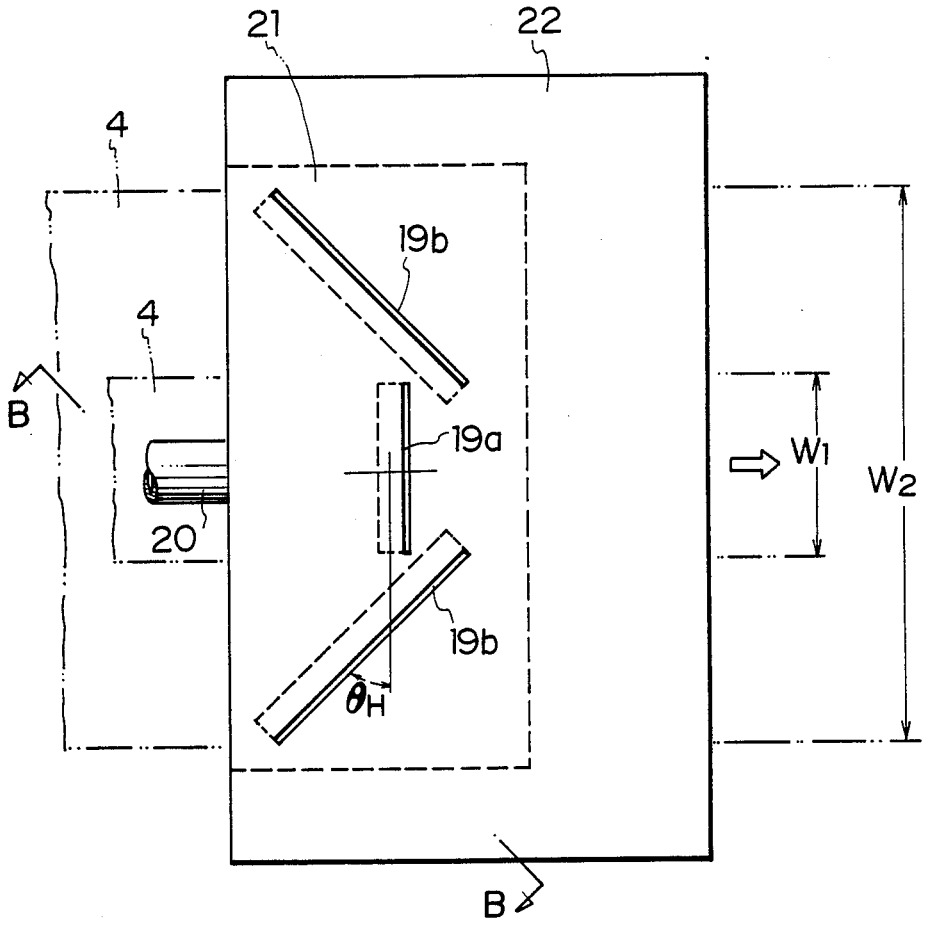
FIG. 5 depicts a plan view of an illustrative embodiment of the invention.
Figure 6:
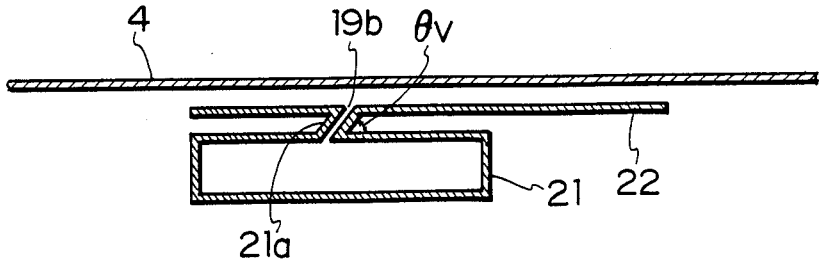
FIG. 6 depicts a cross sectional view taken along B—B of the embodiment of FIG. 5.

FIGS. 5 and 6 show an illustrative embodiment, wherein nozzle header 21 (200 mm×1000 mm×2000 mm) is disposed under a steel strip 4, and a conduit 20 is connected thereto for feeding the plating material, Zn in this case, from a liquid pump (not shown). The nozzle header 21 is centrally defined with a center nozzle 19*a* (5 mm×560 mm), taking into consideration a minimum width (W1) (610 mm) of strip 4, and also defined with edge slit nozzle 19*b* (5 mm×900 mm) by center slit nozzle 19*a*, taking into consideration a maximum width (W2) (1840 mm). The oblique angle ($\theta_H$) and the tilting angle ($\theta_V$) of the edge slit nozzle 19*b* are each 45°, respectively. A guide plate 22 (5 mm×2600 mm×2000 mm) is disposed to have slit nozzles 19*a*, 19*b* in parallel with strip 4 and to keept a wet length. This guide plate 22 is positioned at the same lever or higher than the Zn surface (see Japanese Patent Application No. 54-158,635).

Other dimensions and conditions in the example 1, are as follows:

Distance between strip 4 and guide plate 22: 10 to 30 mm.
Line speed: 90 mpm.
Oblique impeller: 250 mmϕ.
Speed (revolution number): 700 rpm
Jetting speed from nozzle: 1.5 m/s
Jetting amount from nozzle: 1.06 $m^3/m$
Upheaving heaight h: 57 mm.
Flow velocity ($U_H$) in horizontal direction: 0.6 m/s.

In tests made under the above conditions, satisfactory results were obtained without occurence of invasion phenomenon and without occurence of splashing phenomenon.

In the invention, the center slit nozzle 19*a* and the edge slit nozzles may be formed integrally or separately.

EXAMPLE 2

Figure 7:
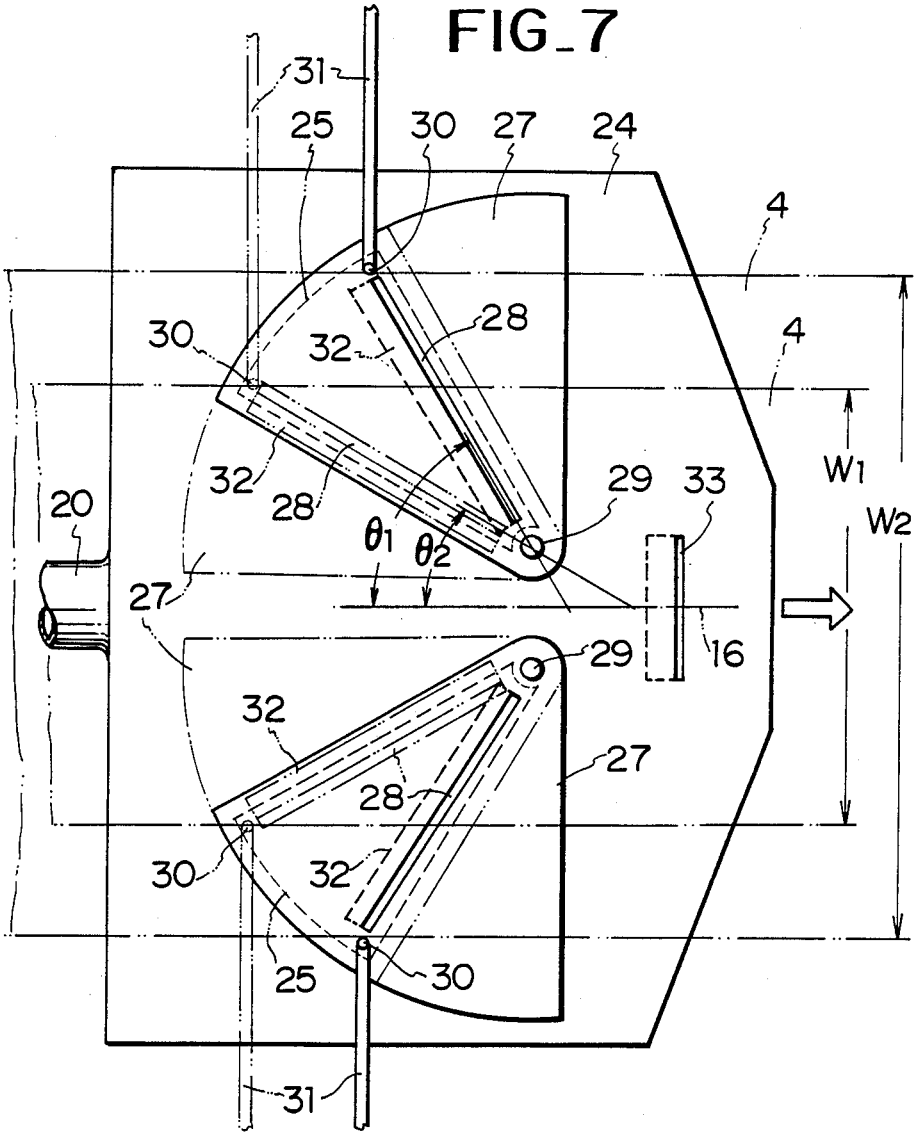
FIG. 7 depicts a plan view of another illustrative embodiment of the invention.
Figure 8:
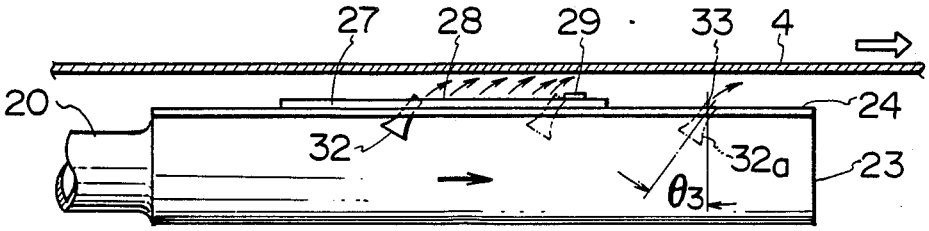
FIG. 8 depicts a side view of the embodiment of FIG. 7.
Figure 9:
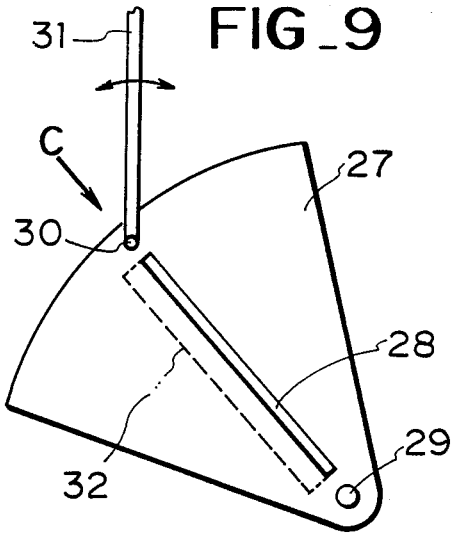
FIG. 9 depicts a plan view of an inventive rotary plate.
Figure 10:
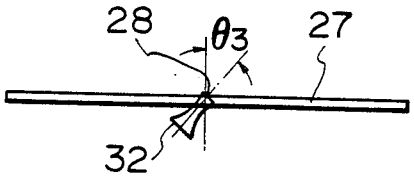
FIG. 10 depicts a side view seen from "C" of the plate of FIG. 9.
Figure 11:
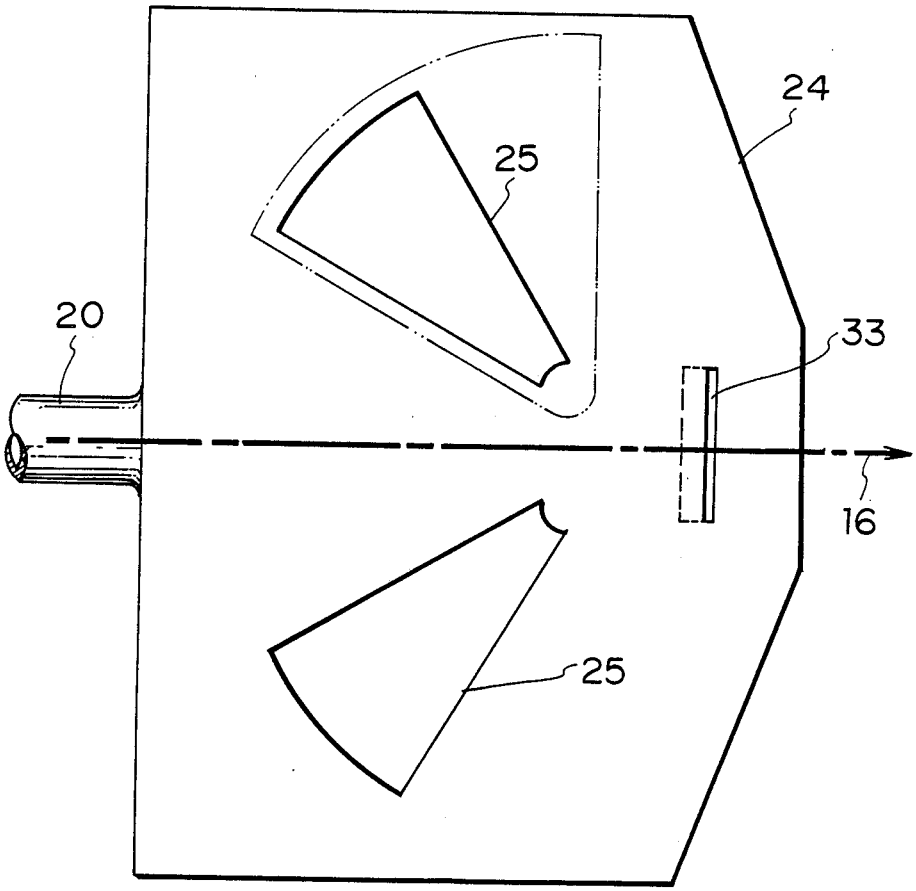
FIG. 11 depicts a plan view of a nozzle header taking away the rotary plate.

FIGS. 7 and 11, which show another illustrative embodiment of the invention, depicts a nozzle header 23 under strip 4 covered with a guide plate 24. Guide plate 24 is, as shown in FIG. 11, defined with a center slit nozzle 33 (length: 312 mm) at a center portion widthwise and is symetrically formed with sector openings 25 around a center line 16 of strip 4. The sector opening 25 is, as shown in FIG. 9, laid thereon with a sector rotating plate 27 which is larger than opening 25, and which is pivoted to guide plate 24 at its top part by pin 29, and is further defined with a radially extending edge slit nozzle 28 (length 637 mm). The edge slit nozzle 28 and center slit nozzle 33 are, as shown in FIGS. 8 and 10, provided on their undersides with throats 32 and 32*a*, corresponding to jetting outlets, as the approach moving intervals of the nozzles. Angles (θ3) of the throats 32 and 32*a*, are each 45° with respect to the vertical line of the respective throat.

The rotating plate 27 is pivoted using a remote control bar 31 disposed to have one end at an appropriate portion. If remote control bar 31 is moved to rotate plate 27 around a fulcrum of pin 29, edge slit nozzle 28 can change the angle to center line 16 of strip 4. That is, when strip 4 is at a maximum width (W2) (1443 mm), edge slit nozzle 28 is 60° (θ1), and when it is at a minimum width (W1) (936 mm), the angle is 30° (θ2). The outermost end portion of the slit nozzle 28 is made to be aligned to the edge portion of strip 4 in accordance with the strip width.

Although this example is more complicated in structure than that of Example 1, the edge slit nozzle 28 does not overlap the strip edge portion. This has certain advantages, such as reducing the chances of jetting plating material onto the non-plating upper surface and being applicable to higher line speeds. In the present example, plating was satisfactorily carried out at a jetting speed of 1.5 m/s and line speeds of up to 150 mpm were employed. The preceding example used speeds of up to 90 mpm.

The present example was applied to strips having widths of 1443 mm to 936 mm. Thus, the range of widths was increased. To increase the range of widths of the strip , the edge slit nozzle length need only be increased. Any width between a minimum and a maximum width can thus be handled easily and simply. Also, it is to be understood that although reference is made to zinc coating on one side of a steel strip, the process and apparatus of this invention can be employed in any process wherein hot dip plating of one side is desired, and wherein such process is continuous and wherein the widths of the moving strip is variable.

SPLASHING PHENOMENON

Figure 12:
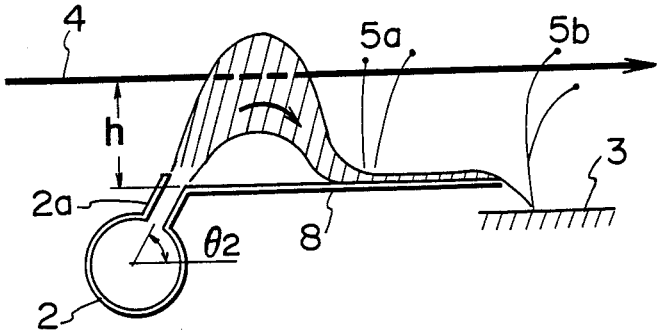
FIG. 12 depicts a view for explaining the occurence of splashing of plating material.

This invention advantageously prevents occurence of the so-called splashing phenomenon. Careful study of the splashing phenomenon was made by the inventors and appropriate provisions were made for overcoming such phenomenon. Obviously, using prior art apparatus, if the nozzle outlet is wider than the strip width, the plating material would be splashed onto the upper surface.. FIG. 12 schematically shows occurence of the splashing phenomenon. At the parts where nozzle outlet 18 is outside of strip 4 (e.g as shown with solid lines in FIG. 4) Zn 3 spouted from outlet 2*a* does not contact the lower side of strip 4, and upheaves to a maximum height and then drops to a guide plate 8. A splash is caused at a dropping point 5*a* against guide plate 8 and a landing point on Zn bath 3.

Figure 13:
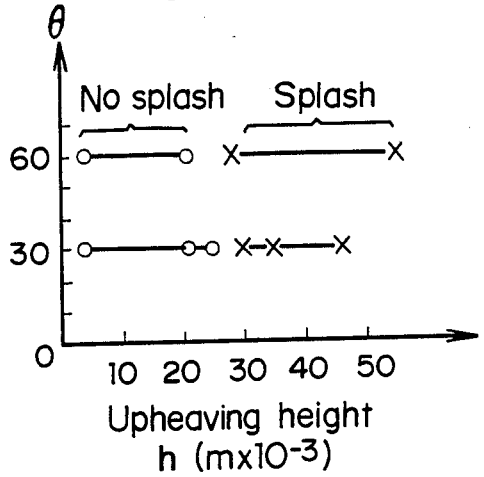
FIG. 13 depicts a graph showing the relationship between upheaving height of molten metal jetted from a nozzle outlet and splashing.

Occurence of splashing at dropping point 5*a* does not depend upon a jetting angle (θ2) as shown in FIG. 13, but is decided by only vertical distance between the maximum position of upheaving and dropping against plate 8; in other words, the head of Zn. The larger is this head, the more easily splashing will occur. It may be stated that occurence of splashing is decided by a speed component vertical with respect to the guide plate 8, and assuming that the head is h, h is equal to the height of Zn upheaving measured from the dropping point on guide plate 8. Component v of the dropping speed theupheaving Zn in the transverse direction with respect to the plate 8 is governed by the expression:

$$v = \sqrt{2gh}\ m/s,$$

wherein g: acceleration of gravity 9.8 $m/s^2$

There are two ways to prevent occurence of splashing at the dropping points 5*a*, and to prevent spotting of unwanted plating material by splashing thereof on non-plating surface of the strip.

(a) A guide plate is not installed, and the Zn surface is made to be at a distance so far away from the height of the strip that the splash does not reach the strip.

(b) The height h is made low (e.g. h=less than 25 mm from experiments conducted by the inventors).

None of these ways are satisfactory as a solution. In the first way (a), since the Zn surface is remote from the jetting outlet, Zn will be solidified before plating the lower surface. In order that the splash not reach the strip, based on experiments, it was found that this distance should be more than 1 m. However, in that case, dross formation is accelerated. Thus, this way is not satisfactory as a solution to splashing phenomenon. In the second way (b), when the height is low, invasion phenomenon occurs and Zn creeps around the edges of the strip to the non-plating surface, especially when flutter or meandering occurs. Thus, this way is not a satisfactory solution and the height h must be higher.

Since the two foregoing ways are not practical in preventing occurence of the splashing phenomenon, the inventors have devised certain countermeasures which are novel and produce unexpectedly good results, namely, the guide plate (such as shown in FIG. 12) is provided with a moderate slant at the part against which the molten plating material drops, and if required, a splash cover may be used near this part. In this manner, the occurence of splashing phenomenon is substantially prevented.

Figure 14:
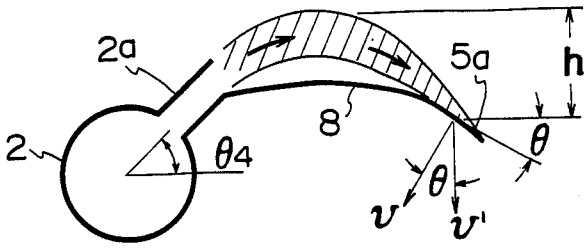
FIG. 14 depicts a view for explaining splash prevention according to the invention.

Referring to FIG. 14, it has been confirmed , through a number of experiments, that when guide plate 8 is flat ( $\theta=0$) and h is more than $28\times10^{-3}$ m, splashing occured irrespective of the jetting angle (04). Also, when $h=25\times10^{-3}$ m, no splashing occured ("25" is obtained from FIG. 13). In other words, speed component v' at Zn dropping point 5*a*, in the vertical direction may be expressed by:

$$v' = \sqrt{2gh}$$

(wherein if the guide plate 8 is horizontal, v' is the speed at right angles to the plate) Then, if v' is in the range:

$$0 \leqq v' = \sqrt{2gh} \leqq \sqrt{2g(25\times10^{-3})}\ m/s.$$

splashing would not occur.

If guide plate 8 were at an oblique angle downward at the Zn dropping point 5*a*, as shown in FIG. 14, the dropping speed component in the right angle of guide plate 8 would be v which is:

$$v = v'\cdot\cos\theta = \cos\theta\cdot\sqrt{2gh}$$

Since splashing does not occur at:

$$v \leqq \sqrt{2g(25\times10^{-3})}\ m/s. \quad (1)$$

$$0 \leqq \cos\theta\cdot\sqrt{2gh} \leqq \sqrt{2g(25\times10^{-3})}$$

$$0 \leqq \cos\theta\cdot\sqrt{h} \leqq \sqrt{25\times10^{-3}} = 0.158$$

$$0 \leqq \cos\theta \leqq \frac{0.158}{\sqrt{h}}$$

Figure 15:
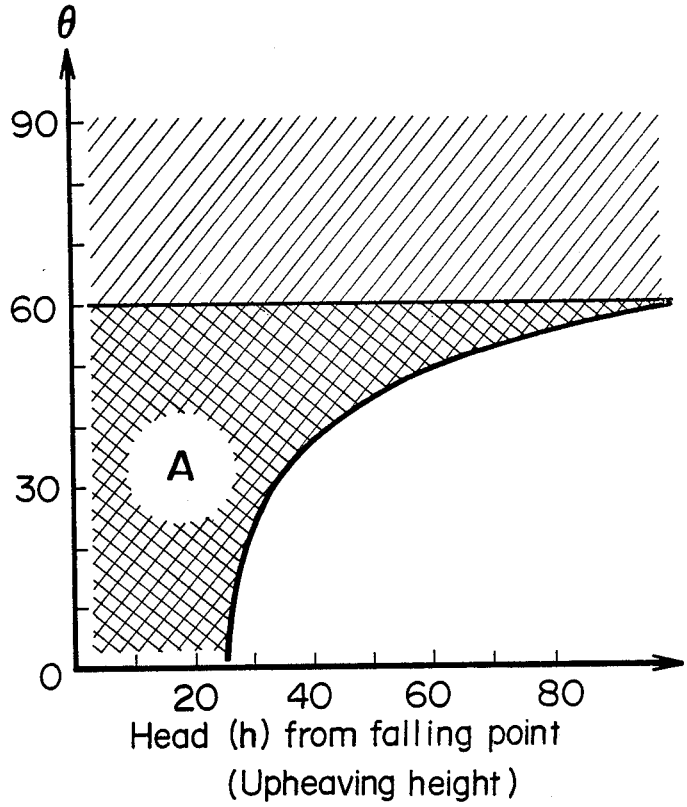
FIG. 15 depicts a graph showing allowable scope of oblique angles of the guide plate.

This expression (1) is shown in FIG. 15. The allowable scop of the oblique angle $\theta$ of guide plate 8 is the hatched area in the graph wherein $0<\theta<90°$. When determining the angle (e.g. $\theta4=60°$) in FIG. 15, depending upon the conditions of jetting angle $\theta4$ in FIG. 14, h and $\theta$ to be allowed at this time, are within the area (A). This means that since the profile of the maximum upheaving face of spouted Zn can be approximated with a parabola and when taking it into consideration that it is preferable to drop the plating material against the guide plate 8 at a flat part of the nozzle outlet, or a lower position, and this dropping position is near to the flat position of the nozzle, the angle ) between the guide plate 8 and the horizontal face (refer to FIG.14) is the scope of $0<\theta<\theta4$, to the jetting angle $\theta4$.

Thus, oblique angle 0 of guide plate 34 should necessarily satisfy the following two conditions:

$$0 \leqq \cos\theta \leqq \frac{0.158}{\sqrt{h}} \quad (1)$$

wherein h is equal to the height of Zn.

$$\theta<\theta4 \quad (2)$$

Figure 16:
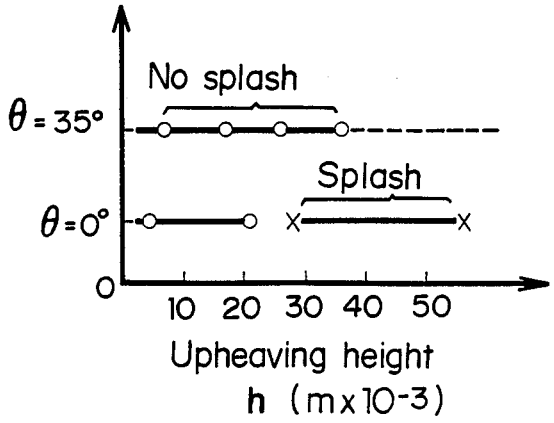
FIG. 16 depicts a graph showing the relationship between the oblique angle disposition of the guide plate and splashing.

FIG. 16 shows results when oblique angle $\theta$ of guide plate 8 was set at 35°, from which it is seen that no splashing occurs when the upheaving height h is higher than when using a flat guide plate.

EXAMPLE 3

Figure 17:
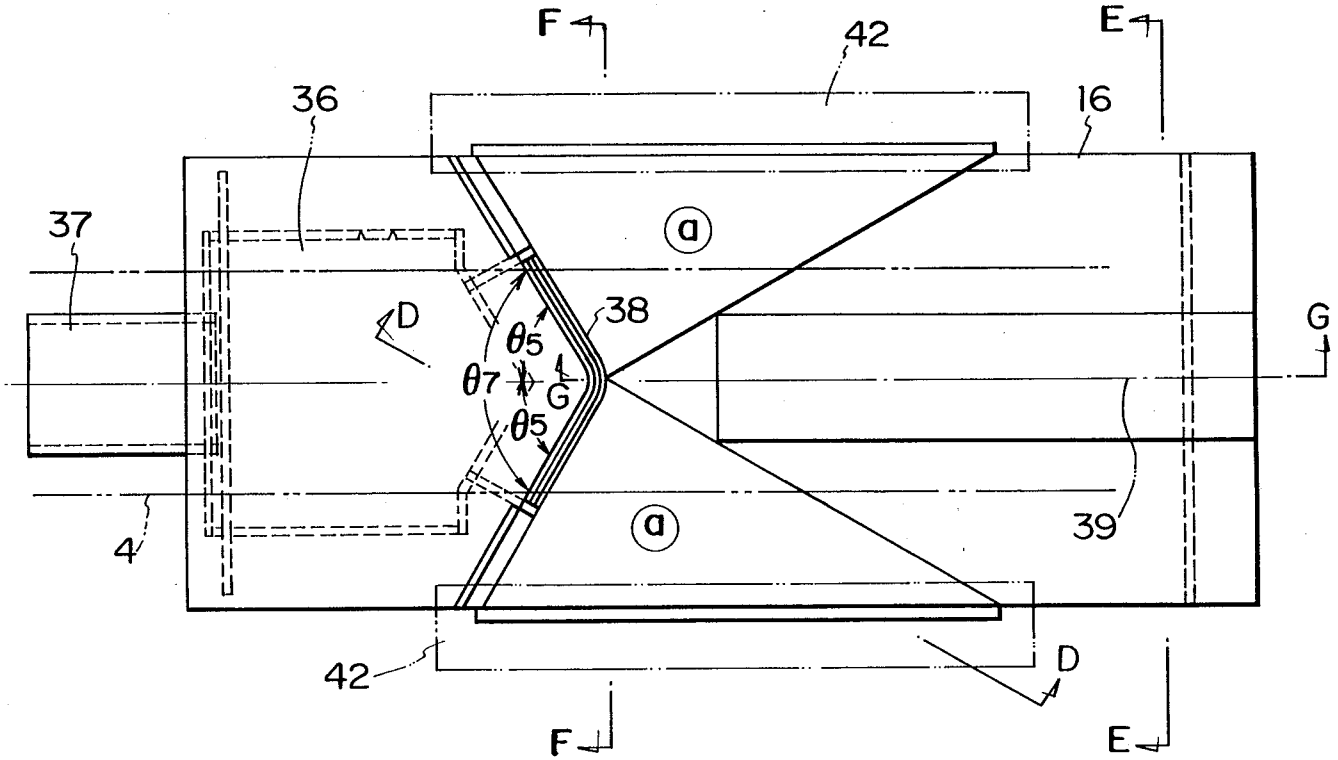
FIG. 17 depicts a plan view showing another illustrative embodiment of the invention.
Figure 18:
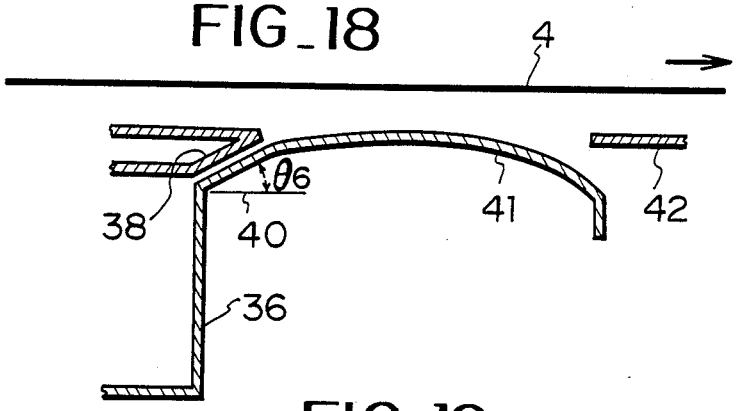
FIG. 18 depicts a cross sectional view taken along D—D of the embodiment of FIG. 17.
Figure 19:
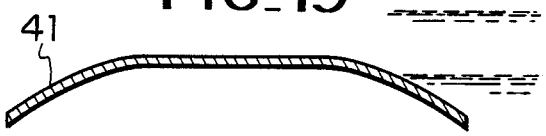
FIG. 19 depicts a cross sectional view taken along E—E of the embodiment of FIG. 17.
Figure 20:
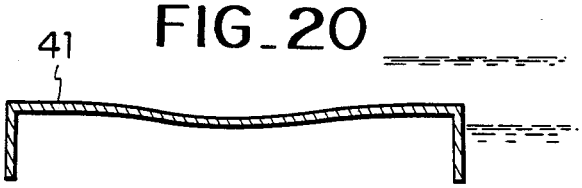
FIG. 20 depicts a cross sectional view taken along F—F of the embodiment of FIG. 17.
Figure 21:
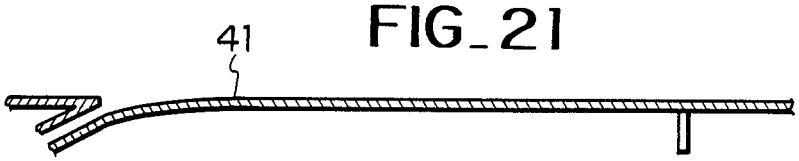
FIG. 21 depicts a cross sectional view taken along G—G of the embodiment of FIG. 17.

FIGS. 17 to 21 show another illustrative embodiment wherein a nozzle header 36 (1500 mm×2000 mm×1500 mm) is arranged under strip 4 (width: 600 mm to 1500 mm) moving horizontally over a plating bath. Nozzle header 36 is connected with a header pipe 37 for feeding molten plating metal , such as zinc, from a pump not shown. Nozzle header 36 is provided at its endpoint with a nozzle outlet 38 (5 mm ×1600 mm) of V shape on a plane. Nozzle outlet 38 projects its ends beyond the edges of strip 4, and these ends are at an oblique angle $\theta5$ of 60°, respectively, with respect to center line 39, and tilted , as shown in FIG. 18, at angle $\theta6$ of 30° with respect to horizontal line 40. In this example, the distance between the lower surface of strip 4 and the end portion of nozzle outlet 38 is from 5 mm to 33 mm.

A guide plate 41 keeps the wet length, and as shown in FIG. 18, jetting direction has a curve of 300 mm R.

Figure 22:
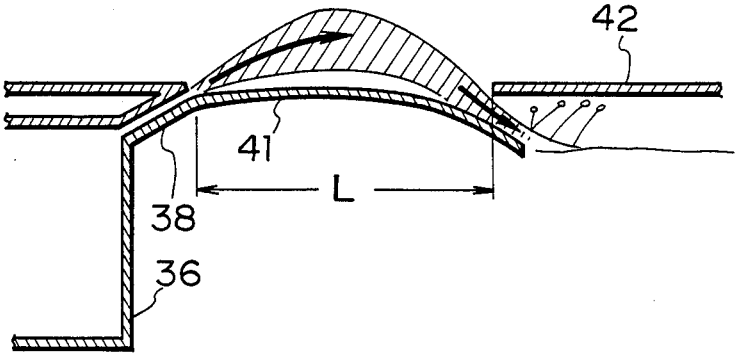
FIG. 22 depicts a view showing another illustrative embodiment of the invention.

In FIG. 22, a splash cover 42 (950 mm×500 mm×5 mm) is disposed for covering the landing point of Zn at both sides of curve portions a in FIG. 17, near the Zn dropping point, for preventing upward splash onto the non-plating surface of the strip, at the Zn dropping point and at the Zn landing point. In this embodiment, the splash cover 42 is at the same height as the nozzle outlet 38 and is separated 450 mm (distance "L" in FIG. 25) therefrom. In case there is no splash at the dropping point, it is sufficient to avoid the occurence of splashing only at the Zn landing point, and then the splash cover 42 may be disposed at a lower position. It is also possible to position this splash cover 42 such that it is movable laterally and vertically (detailed mechanisms not shown). Thus,splashing was prevented even when the upheaving was more than 40 mm in height.

The guide plate is oriented at an oblique angle at the Zn dropping point, with respect to the horizontal surface so that the dropping force against the guide plate is moderate. Splash cover 42 checks the splashes caused when Zn drops from guide plate 41 onto the free surface of the bath. Thus, advantageously, splashing phenomenon was prevented from occuring.

PHENOMENON OF NON-PLATING AND IRREGULAR PLATING

Figure 23:
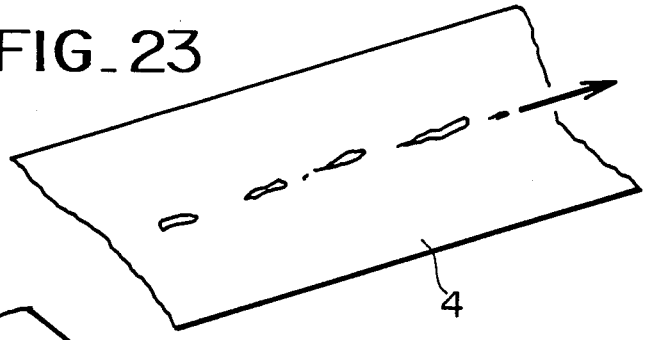
FIG. 23 depicts an explanatory view showing occurence of unacceptable plating.
Figure 24:
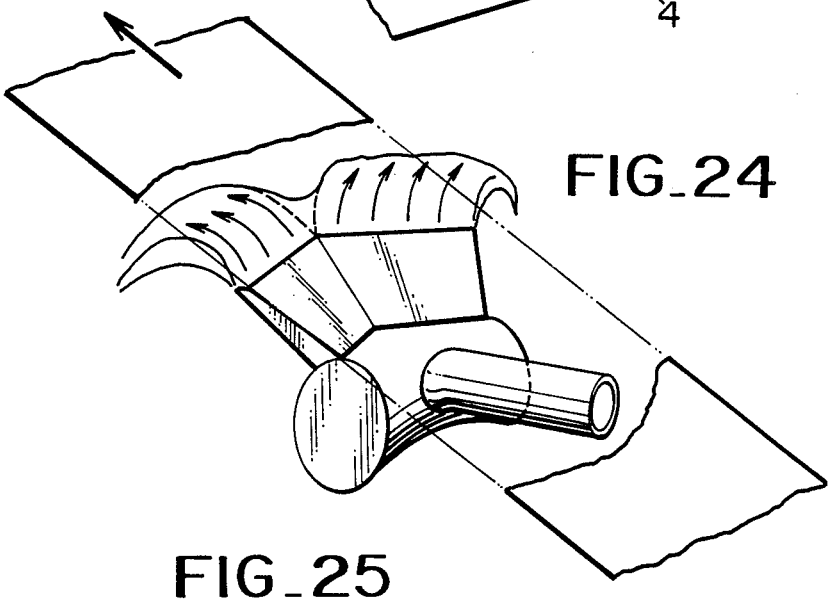
FIG. 24 depicts a perspective view showing jetting of plating material.

As shown in FIG. 23, utilizing various apparatus, non-plating parts were causedto exist on the lower (i.e. plated) surface of strip 4. This is caused by a V shaped nozzle, such as shown in FIG. 17, wherein 07=120° (the angle of the center portion) so that spouting of Zn is lowered in height at this portion. FIG. 24 pictorially shows a cause of such condition. Zn flow is unstable in the low upheave jetted from the central portion of the nozzle, and Zn flow is divided as shown by the dotted lines. Under this condition, the areas toward the center of strip 4 were not receiving plating material, and as shown in FIG. 23, such parts were not plated.

Figure 25:
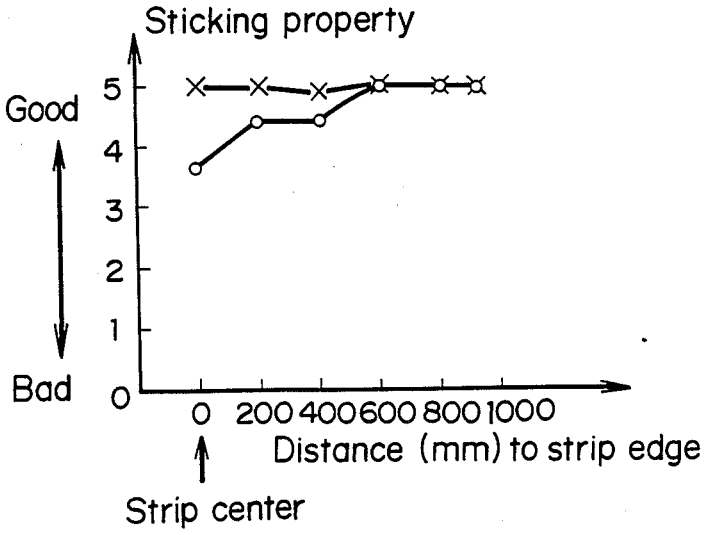
FIG. 25 depicts a graph showing the relationship between distance from the center of the strip to the width and degree of sticking of the plating material.

Also, irregular quality of plating in the width of the strip may exist. FIG. 25 shows the results of our investigations sticking properties in the width of the strip, that is taken from the center and measured outwardly toward the edges. It is seen from the graph that the sticking property shown by "o---0---" is inferior as it goes to the center. This is caused by irregularity in contacting with Zn with respect to the moving direction. The strip edges are in contact for a longer period of time with the plating material than is the center portion. The difference between the sticking at the edges and at the center will be more pronounced the wider the width, such as for a maximum width of 1840 mm.

An improved shape of the jetting nozzle effects uniform upheaval of the plating material and cuases substantially equal contacting time of the plating material and the strip at all locations, i.e. at the edges and at the center and therebetween. The results are shown in FIG. 25 as "x---x---x".

Figure 26:
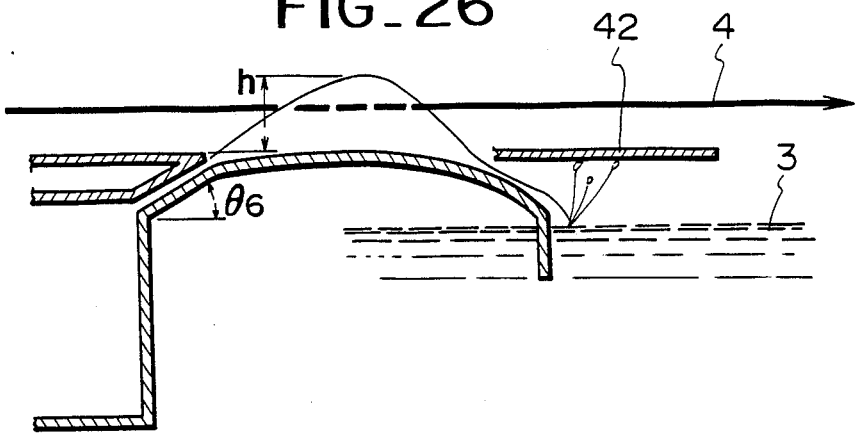
FIG. 26 depicts an explanatory cross sectional view taken along D—D of the embodiment of FIG. 17.
Figure 27:
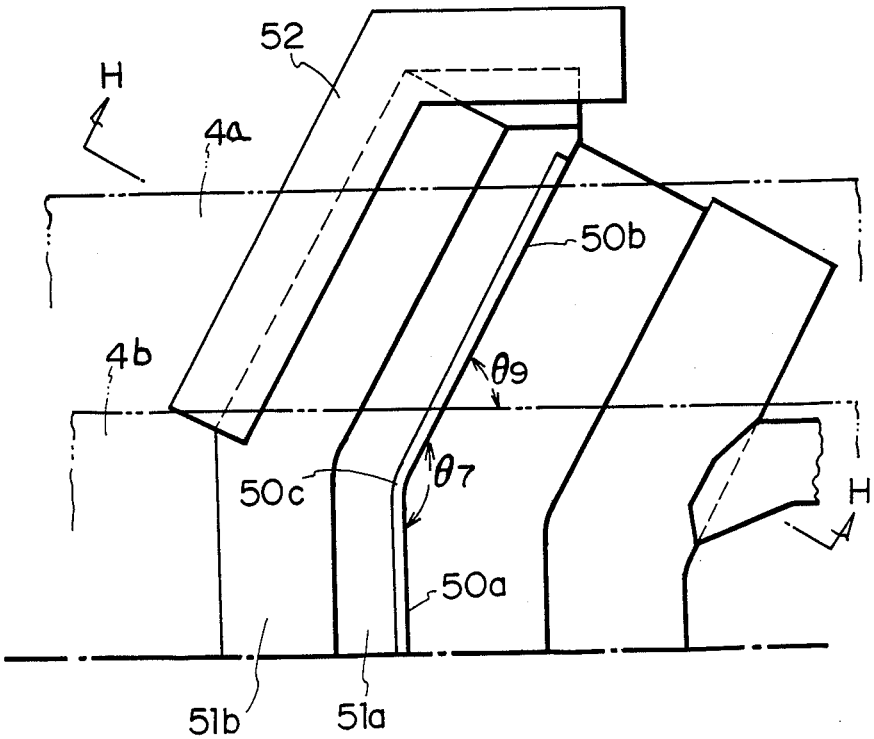
FIG. 27 depicts a plan view of another illustrative embodiment of the invention.

Important elements for effecting uniform Zn upheaval, are angle $\theta 7$ of nozzle at the center shown in FIG. 27, and jetting angle $\theta 6$, with respect to the horizontal direction shown in FIG. 26. As previously discussed, these angles h7, and jetting angle $\theta 6$, with respect to the horizontal direction shown in FIG. 26. As previously discussed, these angles have been determined for turning of Zn at the edges of the strip away from the non-plating upper surface, and the jetting direction of strip edge is an important element. Thus, the above elements were taken into consideration, in designing the Zn jetting nozzle, to overcome the phenomenon on non-plating and irregular plating.

Figure 28:
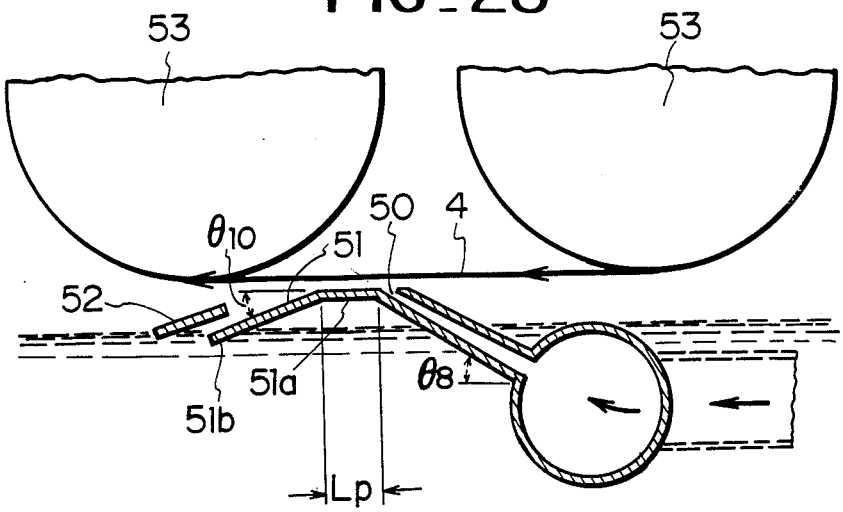
FIG. 28 depicts a cross sectional view taken along H—H of the embodiment of FIG. 27.

FIGS. 27 and 28 show one example of a nozzle shape for strip 4*a* of maximum width and for a strip 4*b* of minimum width. A nozzle outlet 50 is set at its center 50*a*, on a plane, transversely to the moving direction of the strip, in view of the minimum width, and both sides 50*b* of the nozzle outlet (one side is shown in FIG. 27) are bent , on the plane , backwardly.

As shown in FIG. 28, the nozzle outlet is at an oblique angle at a predetermined angle $\theta 8$ to the moving direction of strip 4. Angle $\theta 7$ is an important element for effecting uniform upheaving and is widened to 150° from the above mentioned 120°, and more uniform upheaving was found. While upheaving height is around 20 mm, the bending portion 50*c* is lowered around 1 to 2 mm. Using such measurements, the plating material was substantially always spouted at this lowered portion. If the bending portion 50*c* is modified with a shaped having a radius R, the upheaving would be uniform in height.

Furthermore, when nozzle plate 51 was provided at nozzle outlet 50, as shown in FIG. 28, more effectiveness was brought about. Nozzle plate 51 was composed of a parallel part 51*a* following outlet 50 and an oblique part 51*b* tilting toward the bath surface. The length $L_p$ of the parallel part 51*a* is important to uniformity in width of the contacting length between strip 4 and the Zn, and to filling Zn between strip 4 and parallel part 51*a* so that Zn is contacted with strip 4 at its underside without fail.

The length $L_p$ of this parallel part 51*a* is decided as follows. If $L_p$ were too short, an effect thereby could not be obtained, and if it were too long, the spouted Zn would drop on parallel part 51*a* to cause splash spotting on the non-plated upper surface. Therefore, it is preferable that this parallel part 51*a* have a maximum length within the range wherein the spouted Zn drops beyond the parallel part 51*a*.

Figure 29:
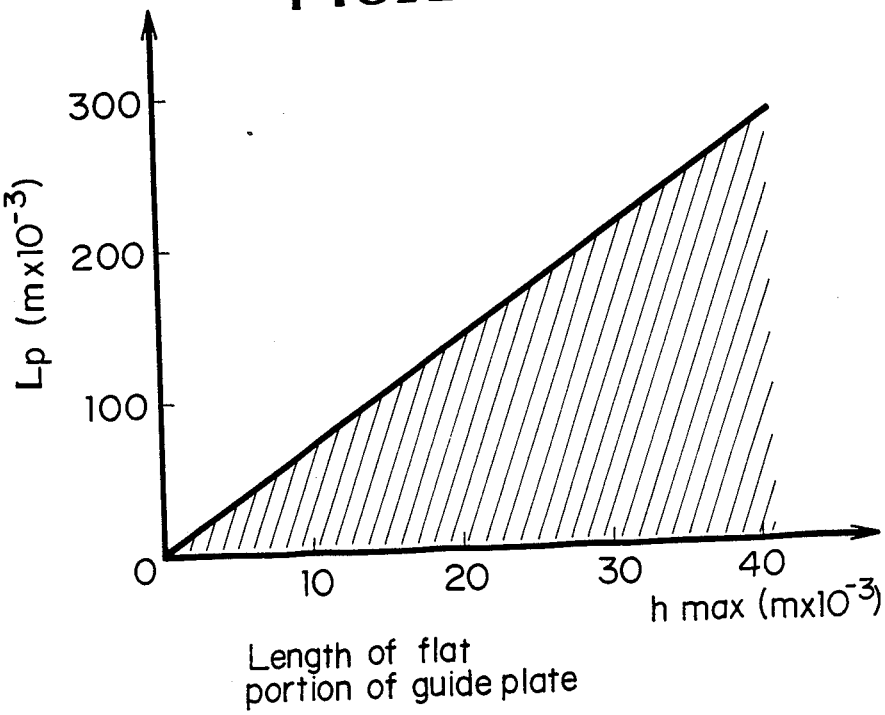
FIG. 29 depicts a graph showing the available length of a flat portion of the guide plate.

The locus of Zn spouted from the nozzle can be approximated with a parabola and it is expressed as follows $$Lp = \frac{4h\ \max}{\tan \theta 8}\ m \qquad (3)$$

wherein "h max" is the height of the Zn upheaving from the nozzle, and "$\theta 8$" is the jetting angle shown in FIG. 28. FIG. 29 shows the above expression (3) at $\theta = 30°$, and the hatching is the allowable scope of angle.

Angle $\theta$shows the above expression (3) at $\theta = 30°$, and the hatching is the allowable scope of angle.

Angle $\theta 10$ of the oblique part 51*b* in FIG. 28 should be $\theta 10 \leqq \theta 8$. In FIGS. 27 and 28, a splash cover 52 is provided above the tilted part 51*b*, and horizontal rolls 53 are used to support and move strip 4.

EXAMPLE 4

In FIGS. 27 and 28, the following dimensions and measurement were used.

Length $L_p$ of parallel part of nozzle plate 51: 100 mm
Jetting angle $\theta 7$ of nozzle: 150°; $\theta 8$: 30°
Oblique angle $\theta 10$ of guide plate: 20°
Shorter side of nozzle outlet: 5 mm.
Width direction: constant
Longer side: 800 mm (taking into consideration the meandering at the center 50*a* as shown in FIG. 27;

Wa = minimum width (900 mm) − 100 mm = 800 mm)

Edges of strips (both sides): 1140 mm.

($Wb$ = maximum width (1840 mm) + 100 mm − $Wa$ = 1140 mm)

R of bending portion 50*e* of both nozzles: 200 mm R
Distance between nozzle and strip: 10 mm.
Height of Zn upheaval: 20 mm (plating was undertaken at part exceeding 10 mm than the upheaving of 10 mm).

As a result, irregularity of plating on the lower surface of strip 4 was completely eliminated, and a product was obtained which was uniform in plating quality over the entire surface of the strip.

According to the present invention, uniform and reliable thorough plating may be continuously carried out on one side of a moving strip without occurence of invasion phenomenon, without occurence of splashing phenomenon, and even when the strip changes its width during the plating.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. An apparatus for plating one side of a metal strip, comprising a bath containing material to be plated on only a lower surface of said strip; means for holding and moving said strip horizontally in a moving direction above a surface of said bath; and nozzle means for jetting said plating material against said lower surface of said strip; wherein said nozzle means are disposed between said surface of said bath and said lower surface of said strip and comprises at least two end nozzles, a center nozzle and a guide plate, said at least two end nozzles having elongated linear outlets disposed horizontally and symmetrically with respect to each other and in horizontal directions at oblique angles ranging from 20° to 70° with respect to said moving direction and further being tilted vertically at angles ranging from 30° to 60°, said center nozzle being disposed in the same horizontal plane as said end nozzles and between said elongated linear outlets of said end nozzles and transverse to said moving direction and comprising an elongated linear outlet covering substantially all of the distance between the outlets of said end nozzles, said guide plate connecting said end nozzles and said center nozzle and having a flat portion extending from said end nozzles and said center nozzle both in directions in and away from said moving direction, said flat portion being substantially parallel to said lower surface of said strip with the center nozzle and the end nozzles being opening in said guide plate;

said nozzle means being formed to be at said oblique horizontal angles, thereby to prevent invasion of said plating material onto the other surface of said strip opposite to said lower surface thereof, and to prevent splashing of said plating material onto said other surface.

2. The apparatus of claim 1, wherein said guide plate comprises a portion in contact with said bath at an oblique angle downward with respect to the surface of said bath.

3. The apparatus of claim 2, wherein said guide plate further comprises an oblique portion connected to said flat portion and tilted toward said surface of said bath.

4. The apparatus of claim 1, wherein said nozzle means further comprises a splash cover disposed between the surface of the bath and the lower surface of the strip and adjacent to the guide plate in the moving direction of the strip for causing said plating material to splash back into said bath.

* * * * *